US006669102B1

(12) United States Patent
Lee

(10) Patent No.: US 6,669,102 B1
(45) Date of Patent: Dec. 30, 2003

(54) METHOD FOR OPERATING AIR CONDITIONER IN WARMING MODE

(75) Inventor: Won Hee Lee, Seoul-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/378,827

(22) Filed: Mar. 5, 2003

(30) Foreign Application Priority Data

Dec. 5, 2002 (KR) ..... 2002-77073

(51) Int. Cl.[7] ..... G05D 23/00
(52) U.S. Cl. ..... 237/2 B; 62/159
(58) Field of Search ..... 237/2 B, 2 R; 62/159, 161, 162, 164; 236/91 D, 91 E, 91 G

(56) References Cited

U.S. PATENT DOCUMENTS 3,984,050 A * 10/1976 Gustafsson ..... 237/2 B
4,000,626 A * 1/1977 Webber ..... 62/175
4,287,723 A * 9/1981 Dosmond ..... 62/238.6
4,384,462 A * 5/1983 Overman et al. ..... 62/175
4,391,104 A * 7/1983 Wendschlag ..... 62/79
4,459,815 A * 7/1984 Yokoyama ..... 62/180
5,195,329 A * 3/1993 Lewis et al. ..... 62/117
5,440,891 A * 8/1995 Hindmon et al. ..... 62/117
6,138,467 A * 10/2000 Lifson et al. ..... 62/217

* cited by examiner

*Primary Examiner*—Derek Boles
(74) *Attorney, Agent, or Firm*—Greenblum & Bernstein, P.L.C.

(57) ABSTRACT

Disclosed is a method for operating an air conditioner equipped with a plurality of compressors in a warming mode, including a 100% operation performing step of operating/stopping all of the compressors, a primary load determining step of determining the current warming load after completion of the 100% operation performing step, a 106%/X% operation performing step of operating all of the compressors when it is determined at the primary load determining step that the warming load is not large, subsequently stopping a part of the compressors, and subsequently stopping the remaining compressor or compressors, a secondary load determining step of determining the current warming load after completion of the 100%/X% operation performing step, and an X% operation performing step of operating/stopping a part of the compressors when it is determined at the secondary load determining step that the warming load is small. In accordance with this method, it is possible to rapidly cope with a warming load generated after the 100% operation performing step, and to reduce the consumption of electric power generated after the 100%/X% operation performing step.

15 Claims, 4 Drawing Sheets

METHOD FOR OPERATING AIR CONDITIONER IN WARMING MODE

BACKGROUND OF THE INVENTION

1. Field of the Invention

The present invention relates to an air conditioner, and more particularly to a method for operating an air conditioner to rapidly and efficiently eliminate a warming load.

2. Description of the Related Art

Generally, an air conditioner is an appliance for cooling or warming a room using a cooling cycle of a refrigerant compressed into a high-temperature and high-pressure state by a compressor.

The compressor includes a compressing unit having a compressing chamber for compressing the refrigerant, and a motor unit for varying the volume of the compressing chamber. In the case of an air conditioner equipped with a plurality of indoor units or a large-capacity air conditioner, a plurality of compressors are used. In association with such an air conditioner, it is possible to reduce the consumption of electric power required to drive compressors by varying the capacity of the compressors in accordance with the load to be eliminated.

FIG. 1 is a schematic diagram illustrating a cooling cycle established in a conventional air conditioner. FIG. 2 is a schematic diagram illustrating a warming cycle established in the conventional air conditioner.

As shown in FIGS. 1 and 2, the conventional air conditioner includes an indoor heat exchanger 2 for heat-exchanging air in a room with a refrigerant, thereby cooling or warming the room, an outdoor heat exchanger 4 serving as a condenser for condensing the refrigerant when the indoor heat exchanger 2 functions as a cooler, while serving as an evaporator for evaporating the refrigerant when the indoor heat exchanger 2 functions as a heater, and first and second compressors 6 and 16 for compressing the refrigerant from a low-temperature and low-pressure gaseous state into a high-temperature and high-pressure gaseous state in order to supply the high-temperature and high-pressure gaseous refrigerant to the indoor heat exchanger 2 or outdoor heat exchanger 4. The air conditioner also includes an expansion device 8 arranged between the indoor heat exchanger 2 and the outdoor heat exchanger 4, and adapted to expand the refrigerant into a low-temperature and a low-pressure state, and a control unit (not shown) for controlling operations of the first and second compressors 6 and 16 in response to an operation of the user and in accordance with the load to be eliminated. The indoor heat exchanger 2, outdoor heat exchanger 4, first and second compressors 6 and 16, and expansion device 8 are connected by a refrigerant pipe 9.

In FIGS. 1 and 2, the reference numeral 24 denotes a common accumulator to which respective suction lines 6*a* and 16*a* of the first and second compressors 6 and 16 are connected. This common accumulator 24 serves to store a liquid refrigerant not evaporated by the indoor heat exchanger 2 or outdoor heat exchanger 4, in order to prevent the liquid refrigerant from being introduced into the first and second compressors 6 and 16. Introduction of such a liquid refrigerant into the compressors 6 and 16 may cause failure of those compressors.

Also, the reference numeral 26 denotes a direction change valve, for example, a 4-way valve, adapted to change the flowing direction of the refrigerant in accordance with a control signal from the control unit so that the air conditioning system is used for a cooling or warming purpose. This 4-way valve 26 communicates with the common accumulator 24 and respective discharge lines 6*b* and 16*b* of the first and second compressors 6 and 16. The 4-way valve 26 guides the high-temperature and high-pressure gaseous refrigerant compressed by the first compressor 6 or second compressor 16 to the outdoor heat exchanger 4 in a cooling mode, while it guides the same gaseous refrigerant to the indoor heat exchanger 2 in a warming mode.

The reference numerals 32 and 34 are check valves respectively installed in the discharge lines 6*b* and 16*b* of the first and second compressors 6 and 16, and adapted to prevent the refrigerant discharged from the currently-operating compressor, for example, the first compressor 6, from being introduced into the currently-stopped compressor, for example, the second compressor 16.

Meanwhile, the first compressor 6 has a capacity of X%, for example, 60%, whereas the second compressor 16 has a capacity of Y%, for example, 40%. Compressor operation is carried out with a capacity of 100%. or X% by operating both the first and second compressors 6 and 16 or operating only the first compressor 6 in accordance with a control signal from the control unit.

Now, the conventional air conditioner having the above described configuration will be described.

When the air conditioner is set to operate in a warming mode under the condition in which a target temperature $T_0$ is set, the control unit first switches the operating position of the 4-way valve 26 to correspond to the warming mode, as shown in FIG. 2, and operates the first and second compressors 6 and 16.

The first and second compressors 6 and 16 discharge a high-temperature and high-pressure gaseous refrigerant which, in turn, passes through the indoor heat exchanger 2. The refrigerant is condensed while discharging heat therefrom around the indoor heat exchanger 2. In this case, the indoor heat exchanger 2 serves as a heater.

The refrigerant condensed into a high-temperature high-pressure liquid state while passing through the indoor heat exchanger 2 then passes through the expansion device 8 which, in turn, expands the refrigerant into a low-temperature and a low-pressure state so as to change the refrigerant into an easily evaporable state. The expanded refrigerant is then sent to the outdoor heat exchanger 4. The refrigerant absorbs heat around the outdoor heat exchanger 4 while passing through the outdoor heat exchanger 4, so that it is evaporated. The resultant refrigerant is introduced into the first and second compressors 6 and 16. Thus, a warming cycle is established.

Once the warming load is substantially eliminated in accordance with the above described operations of the first and second compressors 6 and 16, only the first compressor 6 is repeatedly operated and stopped in order to cope with a subsequent warming load under the condition that the second compressor 16 is maintained in a stopped state.

FIG. 3 is a graph depicting a variation in compression capacity depending on a variation in room temperature in the warming mode of the conventional air conditioner.

When the indoor heat exchanger 4 performs a warming operation in accordance with operations of the first and second compressors 6 and 16, the room temperature T is increased, as shown in FIG. 3. When the room temperature T exceeds an upper temperature limit of $T_0+\Delta T$ higher than the target temperature $T_0$ by an allowable temperature deviation $\Delta T$ of, for example, 0.5° C., the control unit stops the first and second compressors 6 and 16.

Subsequently, the room temperature T decreases gradually because the first and second compressors 6 and 16 are maintained in a stopped state. When the room temperature T is lowered below a lower temperature limit of $T_0-\Delta T$ lower than the target temperature $T_0$ by an allowable temperature deviation $\Delta T$ of, for example, 0.5° C., the control unit again operates the first and second compressors 6 and 16.

On the other hand, when the room temperature T again exceeds the upper temperature limit of $T_0+\Delta T$ in accordance with the re-operations of the first and second compressors 6 and 16, the control unit again stops the first and second compressors 6 and 16.

After operating the first and second compressors 6 and 16 two times in the above manner, the control unit determines that the warming load is substantially eliminated. Based on this determination, the control unit operates only the first compressor 6 when the room temperature T is again lowered below the lower temperature limit of $T_0-\Delta T$, and subsequently stops the first compressor 6 when the room temperature T again exceeds the upper temperature limit of $T_0+\Delta T$.

Thus, the air conditioner copes with subsequent warming loads by repeatedly operating and stopping the first compressor 6.

Although the warming operation of the conventional air conditioner is carried out in such a fashion that an X% operation is repeatedly and intermittently performed following two 100% operations, there is a problem in that the time taken for the room temperature T lowered after the two 100% operations to again reach the target temperature may be lengthened because the X% operation is achieved only by the first compressor 6, so that the X% operation should be carried out for an extended time.

In order to solve the problem caused by the X% operation, another operating method was proposed. In accordance with this operating method, a 100%/X% operation is carried out by operating both the first and second compressors 6 and 16 at an initial stage of the warming mode, thereby performing a 100% operation, stopping the second compressor 16 during the operations of the first and second compressors 6 and 16, thereby performing an X% operation, and stopping the first compressor 6 when the room temperature T exceeds the upper temperature limit of $T_0+\Delta T$. The 100%/X% operation is repeated when the room temperature T is lowered below the lower temperature limit of $T_0-\Delta T$. However, this operating method has a problem in that the consumption of electric power increases because both the first and second compressors 6 and 16 operate even when the room temperature T can rapidly reach the target temperature by operating only the first compressor in accordance with a substantial elimination of the warming load by the 100%/X% operation repeatedly carried out several times.

SUMMARY OF THE INVENTION

The present invention has been made in view of the above mentioned problems involved with the related art, and an object of the invention is to provide a method for operating an air conditioner in a warming mode which is capable of rapidly coping with a warming load while reducing the consumption of electric power.

In accordance with the present invention, this object is accomplished by providing a method for operating an air conditioner equipped with a plurality of compressors in a warming mode by operating a part or all of the compressors in accordance with a warming load to warm air in a room, comprising the steps of: (A) operating/stopping all of the compressors; (B) determining a warming load to be eliminated after execution of the step (A); (C) operating all of the compressors when it is determined at the step (B) that the warming load is not large, subsequently stopping a part of the compressors, and subsequently stopping the remainder of the compressors; (D) determining a warming load to be eliminated after execution of the step (C); and (E) operating/stopping the part of the compressors when it is determined at the step (D) that the warming load is small.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, preferred embodiments of the present invention will be described in detail with reference to the annexed drawings.

Figure 1:
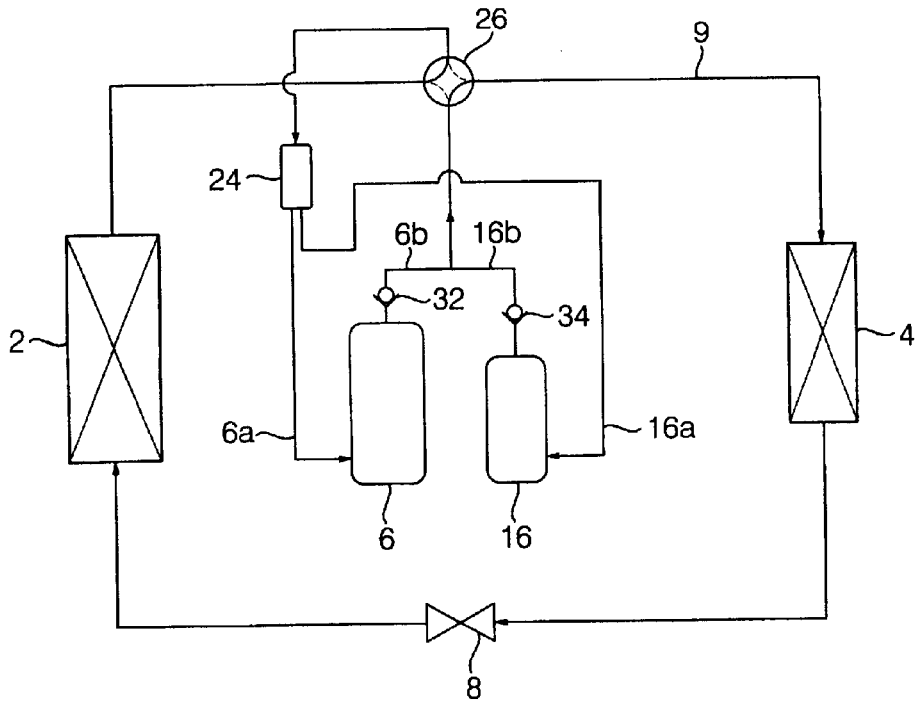
FIG. 1 (Prior Art)
FIG. 1 is a schematic diagram illustrating a cooling cycle established in a conventional air conditioner.
Figure 2:
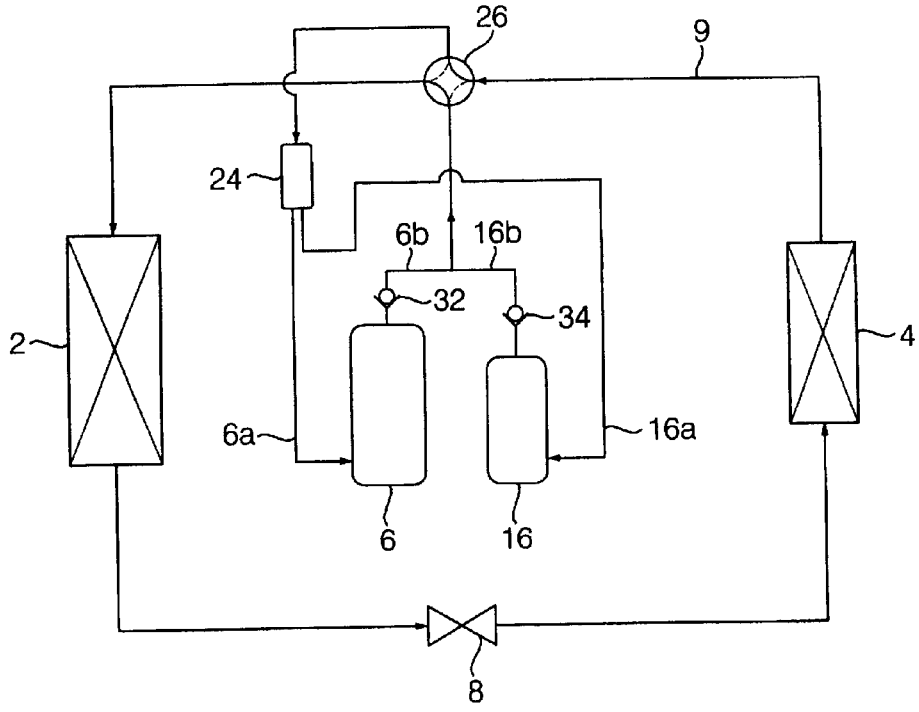
FIG. 2(Prior Art)
FIG. 2 is a schematic diagram illustrating a warming cycle established in the conventional air conditioner.
Figure 3:
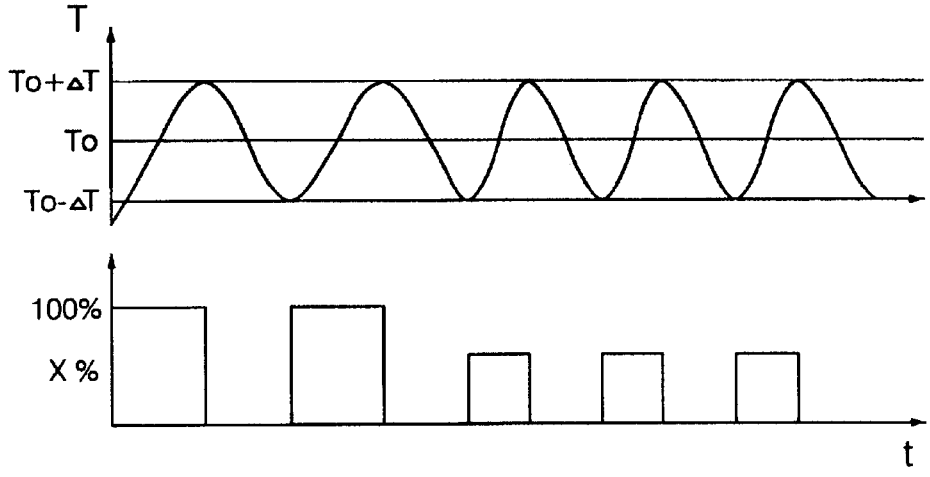
FIG. 3(Prior Art)
FIG. 3 is a graph depicting a variation in compression capacity depending on a variation in room temperature in the warming mode of the conventional air conditioner.
Figure 4:
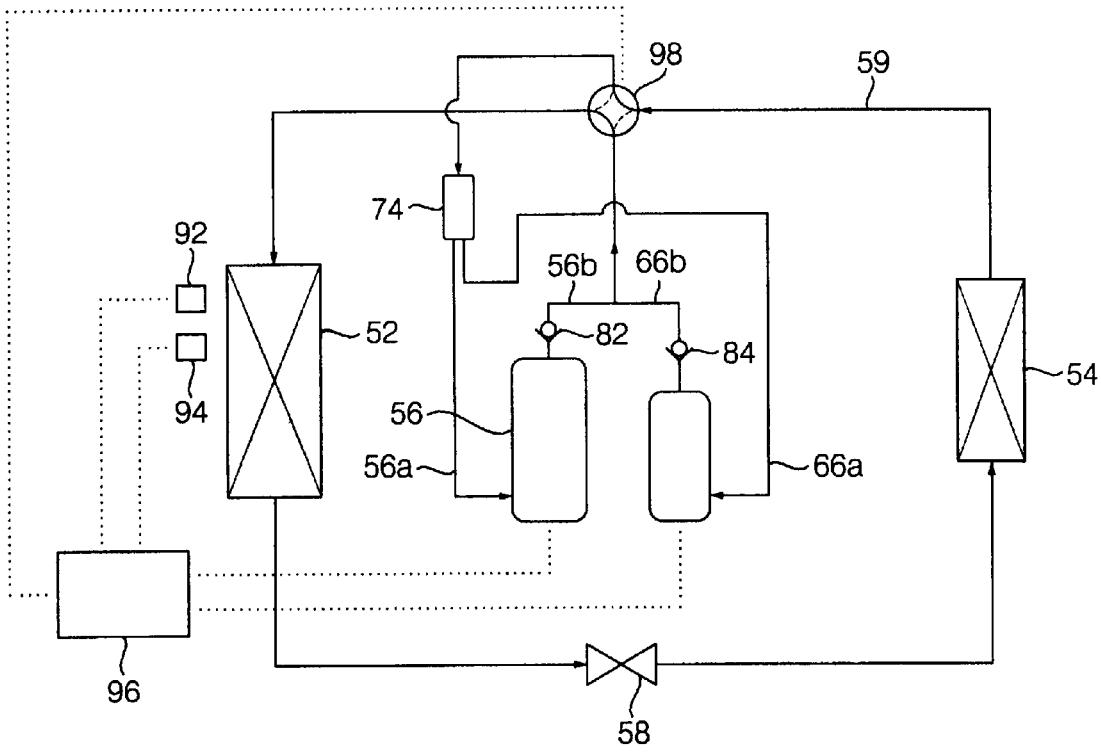
FIG. 4 is a schematic diagram illustrating an air conditioner to which a warming mode operating method according to an embodiment of the present invention is applied.

FIG. 4 is a schematic diagram illustrating an air conditioner to which a warming mode operating method according to an embodiment of the present invention is applied. This air conditioner is of a type equipped with a plurality of compressors.

As shown in FIG. 4, the air conditioner includes an indoor heat exchanger 52 for heat-exchanging air in a room with a refrigerant, thereby cooling or warming the room air, and an outdoor heat exchanger 54 serving as a condenser for condensing the refrigerant when the indoor heat exchanger 52 functions as a cooler, while serving as an evaporator for evaporating the refrigerant when the indoor heat exchanger 52 functions as a heater. The air conditioner also includes first and second compressors 56 and 66 for compressing the refrigerant from a low-temperature and low-pressure gaseous state into a high-temperature and high-pressure gaseous state in order to supply the high-temperature and high-pressure gaseous refrigerant to the indoor heat exchanger 52 or outdoor heat exchanger 54. The first compressor 56 has a capacity of X%, for example, 60%, whereas the second compressor 66 has a capacity of Y%, for example, 40%. The air conditioner further includes an expansion device 58 arranged between the indoor heat exchanger 52 and the outdoor heat exchanger 54, and adapted to expand the refrigerant into a low-temperature and a low-pressure state. The indoor heat exchanger 52, outdoor heat exchanger 54, first and second compressors 56 and 66, and expansion device 58 are connected by a refrigerant pipe 59.

A common accumulator 74 is connected to respective suction lines 56*a* and 66*a* of the first and second compressors 56 and 66. The common accumulator 74 serves to store a liquid refrigerant not evaporated by the indoor heat exchanger 52 or outdoor heat exchanger 54, in order to prevent the liquid refrigerant from being introduced into the first and second compressors 56 and 66.

Check valves 82 and 84 are installed in respective discharge lines 56*b* and 66*b* of the first and second compressors 56 and 66. The check valves 82 and 84 serve to prevent the refrigerant discharged from the currently-operating compressor, for example, the first compressor 56, from being introduced into the currently-stopped compressor, for example, the second compressor 66.

The air conditioner further includes a temperature sensor 92 for sensing the room temperature, an operating panel 94 for inputting an operating signal for the air conditioner, and a control unit 96 for determining, based on signals outputted from the temperature sensor 92 and operating panel 94, whether the first and second compressors 56 and 66 are to be operated or stopped, and outputting control signals to the first and second compressors 56 and 66, respectively.

In FIG. 4, the reference numeral 98 denotes a direction change valve, for example, a 4-way valve, adapted to change the flowing direction of the refrigerant in accordance with a control signal generated from the control unit in response to an operation of the operating panel 94 so that the air conditioner is used for a cooling or warming purpose. This 4-way valve 98 communicates with the common accumulator 74 and respective discharge lines 56*b* and 66*b* of the first and second compressors 56 and 66. The 4-way valve 98 guides the high-temperature and high-pressure gaseous refrigerant compressed by the first compressor 56 or second compressor 66 to the outdoor heat exchanger 54 in a cooling mode, while it guides the same gaseous refrigerant to the indoor heat exchanger 52 in a warming mode.

Figure 5:
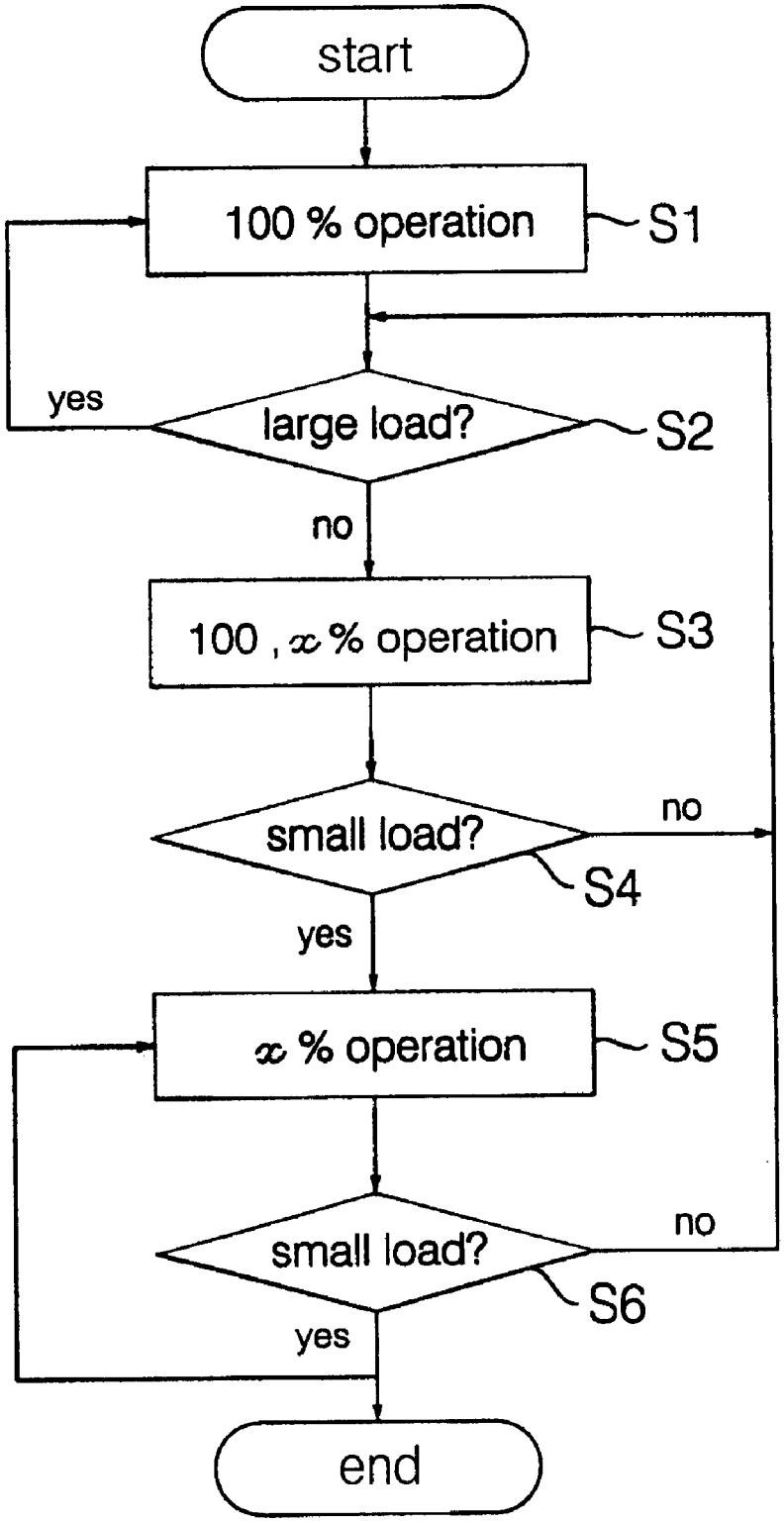
FIG. 5 is a flow chart illustrating a method for operating the air conditioner having the above described configuration in a warming mode in accordance with an embodiment of the present invention.
Figure 6:
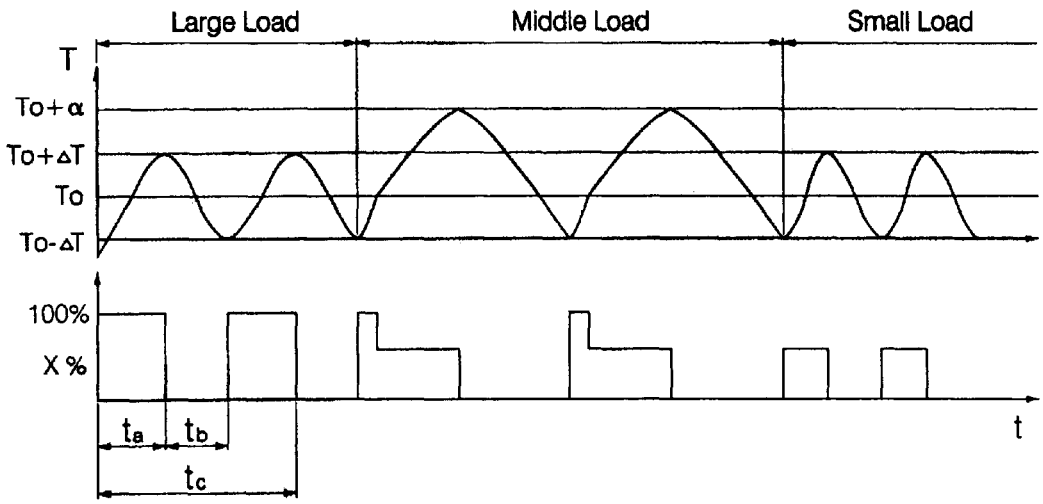
FIG. 6 is a graph depicting a variation in compression capacity depending on a variation in room temperature in the warming mode of the air conditioner in accordance with the embodiment of the present invention.
Figure 7:
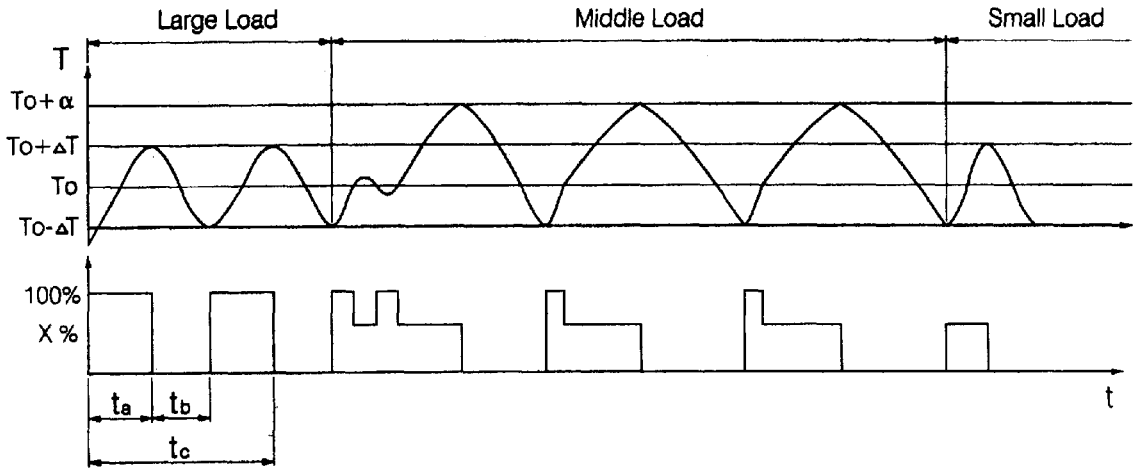
FIG. 7 is a graph depicting a variation in compression capacity depending on a variation in room temperature in the warming mode of the air conditioner in accordance with another embodiment of the present invention.

FIG. 5 is a flow chart illustrating a method for operating the air conditioner having the above described configuration in a warming mode in accordance with an embodiment of the present invention. FIG. 6 is a graph depicting a variation in compression capacity depending on a variation in room temperature in the warming mode of the air conditioner in accordance with the embodiment of the present invention. FIG. 7 is a graph depicting a variation in compression capacity depending on a variation in room temperature in the warming mode of the air conditioner in accordance with another embodiment of the present invention.

Now, the operating method of the present invention will be described with reference to FIGS. 4 to 7. When the air conditioner is set to operate in a warming mode under the condition in which a target temperature $T_0$ is set, in accordance with an operation of the operating panel 94, the control unit 96 first switches the operating position of the 4-way valve 98 to correspond to the warming mode.

Thereafter, the control unit 96 compares the room temperature T with the target temperature $T_0$. When it is determined that the room temperature T is lower than the target temperature $T_0$, a 100% operation is carried out in which both the first and second compressors 56 and 66 are operated (Step S1).

In accordance with the operations of the first and second compressors 56 and 66, the room temperature T is increased. When the room temperature T reaches an upper temperature limit of $T_0+\Delta T$ higher than the target temperature $T_0$ by an allowable temperature deviation $\Delta T$ of, for example, 0.5° C., the control unit 96 stops the first and second compressors 56 and 66 to complete the 100% operation.

After the completion of the 100% operation, the control unit 96 determines the current warming load (Step S2).

This warming load determination is achieved by sensing the time $t_a$ taken until the first and second compressors 56 and 66 are stopped after beginning to operate, and determining the warming load to be large when the sensed time $t_a$ is not less than a first predetermined time $t_x$, while determining the warming load to be small when the sensed time $t_a$ is less than the first predetermined time $t_x$.

Alternatively, the warming load determination may be achieved by sensing the time $t_b$ taken until the room temperature T reaches a lower temperature limit of $T_0-\Delta T$ lower than the target temperature $T_0$ by an allowable temperature deviation $\Delta T$ of, for example, 0.5° C., after the first and second compressors 56 and 66 operating in the 100% operation mode are stopped, and determining the warming load to be large when the sensed time $t_b$ is not more than a second predetermined time $t_y$, while determining the warming load to be small when the sensed time $t_b$ is less than the first predetermined time $t_y$. Also, it is possible to utilize the time "$t_a+t_b$" taken until the room temperature T reaches the lower temperature limit of $T_0-\Delta T$ lower than the target temperature $T_0$ by the allowable temperature deviation $\Delta T$, after the first and second compressors 56 and 66 begin to operate, or the time $t_c$ taken for the first and second compressors 56 and 66 to complete two cycles of operating and stopping.

If it is determined that the warming load is large, the control unit 96 then repeats the 100% operation. If not, the control unit 96 performs a 100%/X% operation by stopping the second compressor 66 during the 100% operation of operating both the first and second compressors 56 and 66, thereby performing an X% operation, and subsequently stopping the first compressor 56 (Step S3).

The repetition of the 100% operation is achieved by operating both the first and second compressors 56 and 66 when the room temperature T is lowered to the lower temperature limit of $T_0-\Delta T$ lower than the target temperature $T_0$ by the allowable temperature deviation $\Delta T$ after the completion of the 100% operation, and stopping the first and second compressors 56 and 66 when the room temperature T increases to the upper temperature limit of $T_0+\Delta T$ higher than the target temperature $T_0$ by the allowable temperature deviation $\Delta T$ (for example, 0.5° C.) in accordance with the operations of the first and second compressors 56 and 66, thereby completing the 100% operation.

Meanwhile, the 100%/X% operation is achieved by a control operation of the control unit 96 for operating both the first and second compressors 56 and 66, that is, performing the 100% operation, when the room temperature T is lowered to the lower temperature limit of $T_0-\Delta T$ after the completion of the 100% operation, and stopping the second compressor 66 when the room temperature T increases above the target temperature $T_0$ in accordance with the operations of the first and second compressors 56 and 66, so as to operate only the first compressor 56, thereby performing the X% operation.

That is, since most warming loads are eliminated in accordance with the initial 100% operation, and a subsequent warming load is substantially eliminated in accordance with the 100% operation of the 100%/X% operation mode (Step S4), the compressor operation mode is switched from the 100% operation to the X% operation so as to reduce the consumption of electric power.

In accordance with the operation of the first compressor 56 alone in the 100%/X% operation mode, the room temperature T may be maintained at the target temperature $T_0$, may continuously increase above the target temperature $T_0$, as shown in FIG. 6, or may be continuously lowered below the target temperature $T_0$, as shown in FIG. 7.

When the room temperature T increases continuously and reaches a predetermined temperature of $T_0+\alpha$ higher than the target temperature $T_0$ by a certain temperature deviation $\alpha$ of, for example, 1°, as shown in FIG. 6, the control unit 96 determines that the warming load is completely eliminated. Based on this determination, the control unit 96 completes the 100%/X% operation by stopping the currently-operating first compressor 56.

The predetermined temperature of $T_0+\alpha$ is a reference temperature higher than the upper temperature limit of $T_0+\Delta T$ (the target temperature $T_0$+the allowable temperature deviation $\Delta T$). Accordingly, it is possible to minimize the number of repetitions of the 100%/X% operation because the execution time of the X% operation in the 100%/X% operation mode is lengthened, as compared to the case in which the predetermined temperature of $T_0+\alpha$ is equal to or lower than the upper temperature limit of $T_0+\Delta T$.

On the other hand, when the room temperature T is lowered below the target temperature $T_0$, as shown in FIG. 7, the control unit 96 determines that the warming load has not been eliminated yet. Based on this determination, the control unit 96 again operates the stopped second compressor 66 until the room temperature T reaches the target temperature $T_0$. When the room temperature T reaches the target temperature $T_0$, the control unit 96 again stops the second compressor 66.

Following the 100%/X% operation, the control unit 96 determines the current warming load (Step S4). This warming load determination following the 100%/X% operation may be carried out based on the time taken for the room temperature T to vary to a certain temperature, as in the warming load determination following the 100% operation, or may be carried out based on the number of successive stoppages of the first compressor 56 during the 100%/X% operation.

That is, when the first compressor 56 stops successively two times during the 100%/X% operation (that is, when the number of successive re-operation times of the second compressor 66 is less than 2), as shown in FIGS. 6 and 7, it is considered that it is possible to eliminate a subsequent warming load by operating the first compressor 56 alone, so that the warming load is determined to be small. On the other hand, when the number of successive stopping times of the first compressor 56 is less than 2 (that is, when the 100%/X% operation is carried out only one time, or the second compressor 66 is re-operated), it is considered that it is impossible to eliminate a subsequent warming load by operating the first compressor 56 alone, so that the warming load is determined not to be small.

Where the warming load is not small, the control unit 96 determines again whether or not the warming load is large. If it is determined that the warming load is large, the 100% operation is then carried out. If not, the 100%/X% operation is repeated.

On the other hand, where the warming load is small, the X% operation is carried out by operating/stopping the first compressor 56 alone (Step S5).

The X% operation is achieved by a control operation of the control unit 96 for operating only the first compressor 56 when the room temperature T is lowered to the lower temperature limit of $T_0-\Delta T$ after the completion of the 100%X% operation, and subsequently stopping the first compressor 56 when the room temperature T increases to the upper temperature limit of $T_0+\Delta T$ in accordance with the operation of the first compressor 56, thereby completing the X% operation.

Following the completion of the X% operation, the control unit 96 determines the current warming load (Step S6). When it is determined that the warming load is small, the control unit 96 repeats the X% operation. On the other hand, when the warming load is determined not to be small, the control unit 96 determines again whether or not the warming load is large. If the warming load is determined to be large, the 100% operation is carried out. If not, the 100%/X% operation is carried out.

Meanwhile, although not shown in FIG. 5, the user can stop the operation of the air conditioner under any operating condition of the air conditioner, if necessary.

As apparent from the above description, the present invention provides a method for operating an air conditioner equipped with a plurality of compressors in a warming mode, including a 100% operation performing step of operating/stopping all of the compressors, a primary load determining step of determining the current warming load after completion of the 100% operation performing step, a 100%/X% operation performing step of operating all of the compressors when it is determined at the primary load determining step that the warming load is not large, subsequently stopping a part of the compressors, and subsequently stopping the remaining compressor or compressors, a secondary load determining step of determining the current warming load after completion of the 100%/X% operation performing step, and an X% operation performing step of operating/stopping a part of the compressors when it is determined at the secondary load determining step that the warming load is small. In accordance with this method, it is possible to rapidly cope with a warming load generated after the 100% operation performing step, and to reduce the consumption of electric power generated after the 100%/X% operation performing step.

The 100%/X% operation consumes less electric power while providing an effect of making the room temperature as nearly approximate to a target temperature as possible because a part of the compressors are stopped when the room temperature is not less than the target temperature.

In accordance with the 100%/X% operation, the stopped compressors are re-operated when the room temperature is lowered below the target temperature after the stopping of those compressors. Accordingly, it is possible to prevent the room temperature from being lowered below the target temperature during the 100%/X% operation, and to obtain a high response to warming load.

In accordance with the 100%/X% operation, the remaining compressor or compressors are stopped when the room temperature increases to or above a predetermined temperature after the stopping of the part of the compressors. Accordingly, it is possible to minimize the 100% operation to be subsequently carried out, because the X% operation is carried out for an increased time span.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for operating an air conditioner having a plurality of compressors and heating a room, the method comprising:

operating and subsequently stopping all of the plurality of compressors;

determining whether a heat load is smaller than a first predetermined value after all of the plurality of compressors are stopped;

operating, when it is determined that the heat load is smaller than the first predetermined value, all of the plurality of compressors, subsequently stopping at least one of the plurality of compressors, and subsequently stopping the remainder of the plurality of compressors;

determining whether a heat load is smaller than a second predetermined value after the remainder of the plurality of compressors is stopped; and operating and subsequently stopping a part of the plurality of compressors when it is determined that the heat load is smaller than the second predetermined value.

2. The method according to claim 1, wherein operating and subsequently stopping all of the plurality of compressors comprises operating all of the plurality of compressors when a room temperature is lower than a target temperature.

3. The method according to claim 1, wherein the operating and subsequently stopping all of the plurality of compressors comprises stopping all of the compressors when the room temperature reaches a first predetermined temperature, which is higher than a target temperature by a predetermined amount.

4. The method according to claim 1, wherein after it is determined that the heat load is smaller than the first predetermined value, all of the plurality of compressors are operated when the room temperature drops to a second predetermined temperature, which is lower than a target temperature by a predetermined amount.

5. The method according to claim 1, wherein the at least one of the plurality of compressors is stopped when the room temperature reaches a target temperature.

6. The method according to claim 5, further comprising re-operating the stopped at least one of the plurality of compressors when the room temperature drops to lower than the target temperature after the at least one of the plurality of compressors is stopped.

7. The method according to claim 5, wherein the remainder of the compressors is stopped when the room temperature reaches a third predetermined temperature after the at least one of the plurality of compressors is stopped.

8. The method according to claim 7, wherein the third predetermined temperature is higher than the target temperature by a predetermined amount.

9. The method according to claim 1, wherein the part of the plurality of compressors is operated when the room temperature drops to a fourth temperature, which is lower than a target temperature by a predetermined amount.

10. The method according to claim 1, wherein the part of the plurality of compressors is stopped when the room temperature reaches a fifth temperature, which is higher than a target temperature by a predetermined amount.

11. The method according to claim 1, further comprising operating and subsequently stopping all of the plurality of compressors, when it is determined after the operating and subsequently stopping all of the plurality of compressors that the heat load is not smaller than the first predetermined value.

12. The method according to claim 1, further comprising determining whether a heat load is smaller than the first predetermined value, when it is determined, after the remainder of the plurality of compressors is stopped, that the heat load is not smaller than the second predetermined value.

13. The method according to claim 1, further comprising:

determining whether a heat load is smaller than the second predetermined value after the operating and subsequently stopping the part of the plurality of compressors;

operating and subsequently stopping the part of the plurality of compressors, when it is determined that the heat load is smaller than the second predetermined value; and determining whether the heat load is smaller than the first predetermined value, when it is determined that the heat load is not smaller than the second predetermined value.

14. The method according to claim 1, wherein the determining whether the heat load is smaller than the first predetermined value comprises:

sensing a running period between the start of the operation of all of the plurality of compressors and the stopping of all of the plurality of compressors; and comparing the running period and the first predetermined value.

15. The method according to claim 1, wherein the determining whether the heat load is smaller than the first predetermined value comprises:

sensing a cooling period that a room temperature drops to a sixth predetermined temperature after the stopping of all of the plurality of compressors; and comparing the cooling period and the first predetermined value.

* * * * *

UNITED STATES PATENT AND TRADEMARK OFFICE

CERTIFICATE OF CORRECTION

PATENT NO. : 6,669,102 B1
DATED : December 30, 2003
INVENTOR(S) : W. H. Lee

It is certified that error appears in the above-identified patent and that said Letters Patent is hereby corrected as shown below:

Title page,
Item [57], ABSTRACT,
Line 7, "106%/X%" should be -- 100%/X% --.

Signed and Sealed this

Twentieth Day of July, 2004

JON W. DUDAS
*Acting Director of the United States Patent and Trademark Office*